US006651262B1

(12) United States Patent
Tinsley

(10) Patent No.: US 6,651,262 B1
(45) Date of Patent: Nov. 25, 2003

(54) FOOT OPERATED COMMODE SYSTEM

(76) Inventor: Keven Tinsley, 9456 S. Evans Ave., Inverness, FL (US) 34452

( * ) Notice: Subject to any disclaimer, the term of this patent is extended or adjusted under 35 U.S.C. 154(b) by 0 days.

(21) Appl. No.: 10/353,706

(22) Filed: Jan. 29, 2003

(51) Int. Cl.[7] ..... A47K 13/10
(52) U.S. Cl. ..... 4/246.1
(58) Field of Search ..... 4/246.1, 246.3, 4/246.4, 246.5

(56) References Cited

U.S. PATENT DOCUMENTS

| | | | | | |
|---|---|---|---|---|---|
| 2,661,484 | A | * | 12/1953 | Jung | 4/246.5 |
| 4,150,446 | A | * | 4/1979 | Crocker | 4/246.3 |
| 4,426,743 | A | * | 1/1984 | Seabrooke | 4/246.3 |
| 4,470,161 | A | * | 9/1984 | Seabrooke | 4/246.3 |
| 5,323,496 | A | * | 6/1994 | Blair | 4/246.3 |
| 6,112,336 | A | * | 9/2000 | Markle et al. | 4/246.1 |
| 6,308,347 | B1 | * | 10/2001 | King | 4/246.1 |

* cited by examiner

*Primary Examiner*—Gregory Huson
*Assistant Examiner*—Huyen Le
(74) *Attorney, Agent, or Firm*—Edward P. Dutkiewicz

(57) ABSTRACT

A commode has a base, a reservoir, a lid adapted to couple to the top of the reservoir, a flushing apparatus coupled to the reservoir and with a handle, a seat with a first hinge coupled to the commode base and a cover with a second hinge coupled to the commode base. A foot apparatus has three peddles each with a peddle base with a pivot axis adapted to couple to the peddle. An operative end of each pedal is coupled to an ensheathed wire. A seat raising apparatus has a platform coupled to the base of the commode with a first lever coupled to the platform coupled to the wire of the second peddle and the seat of the commode adjacent to the first hinge. A cover raising apparatus has a second lever coupled to the platform with the second lever being coupled to the wire of the third peddle and the cover of the commode adjacent to the second hinge.

6 Claims, 8 Drawing Sheets

FIG 3
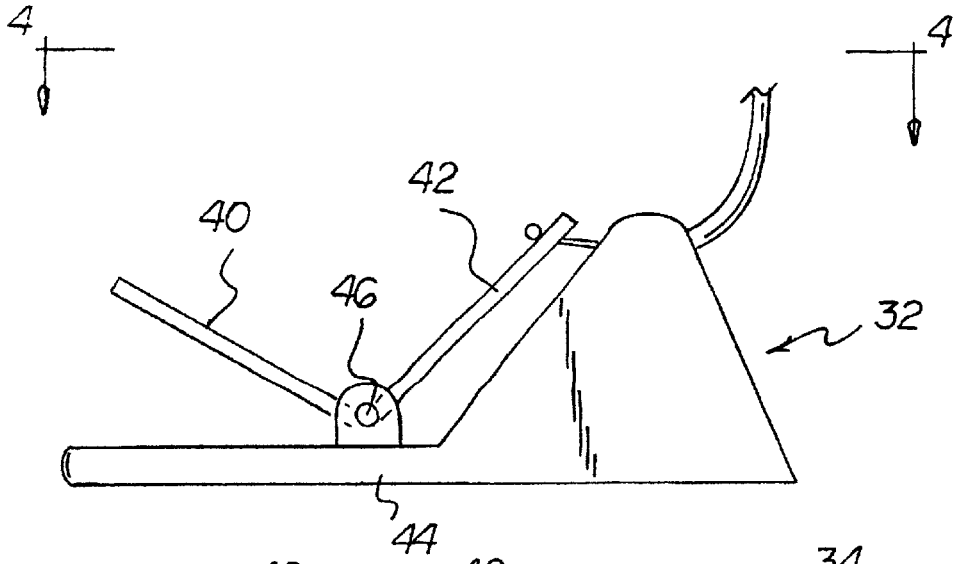
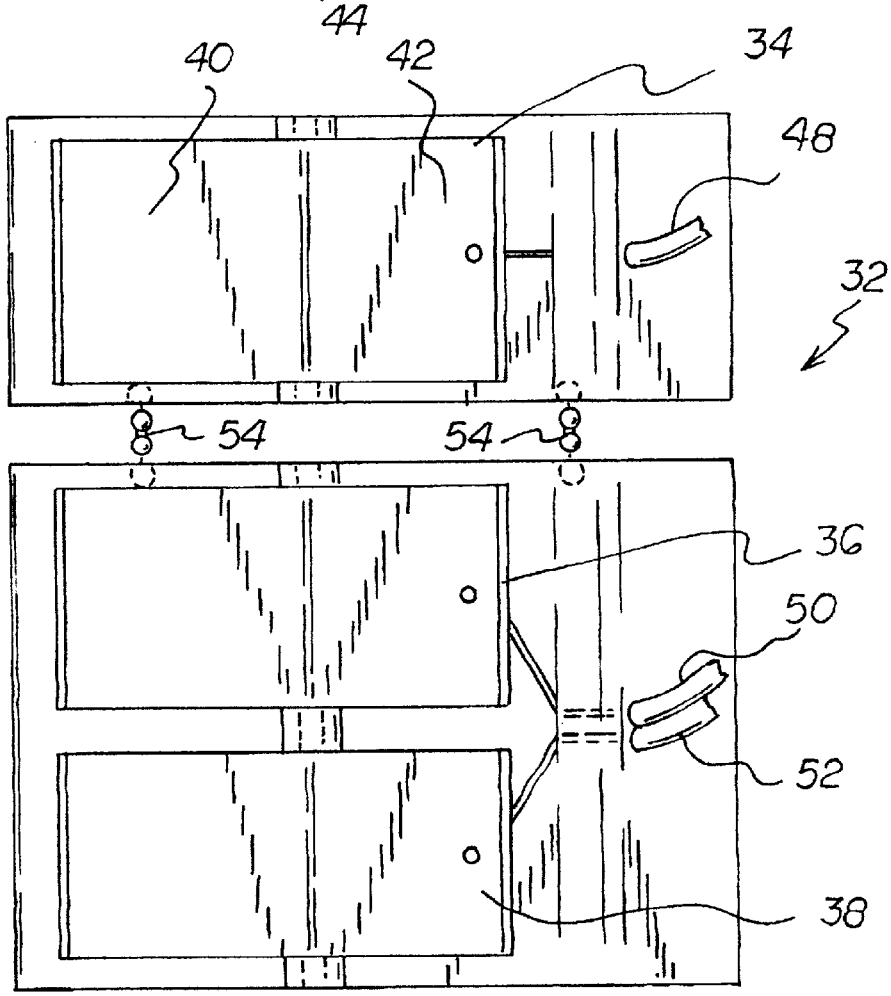
FIG 4

FIG 5
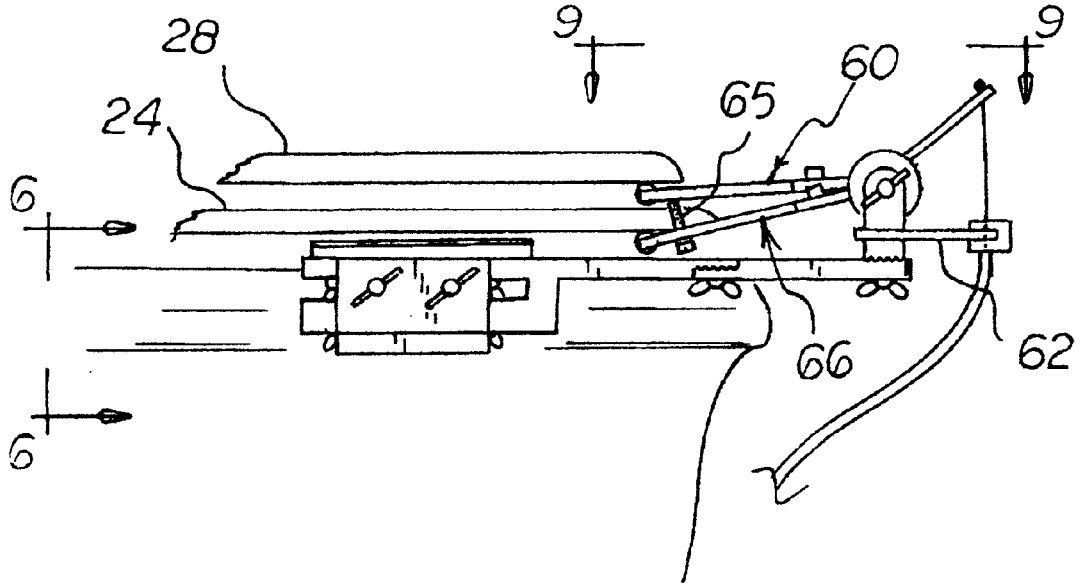
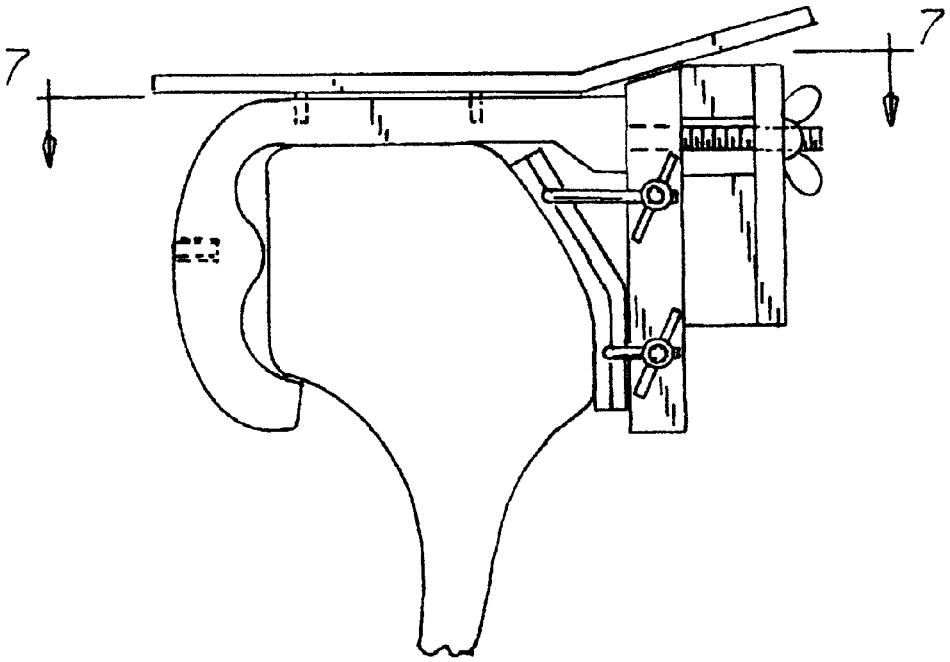
FIG 6

FIG 12
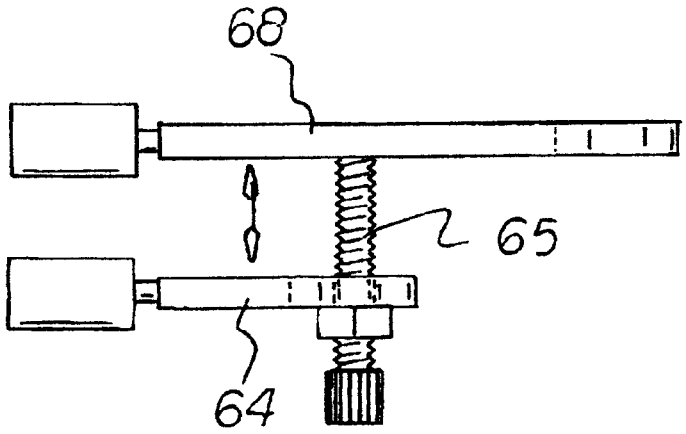
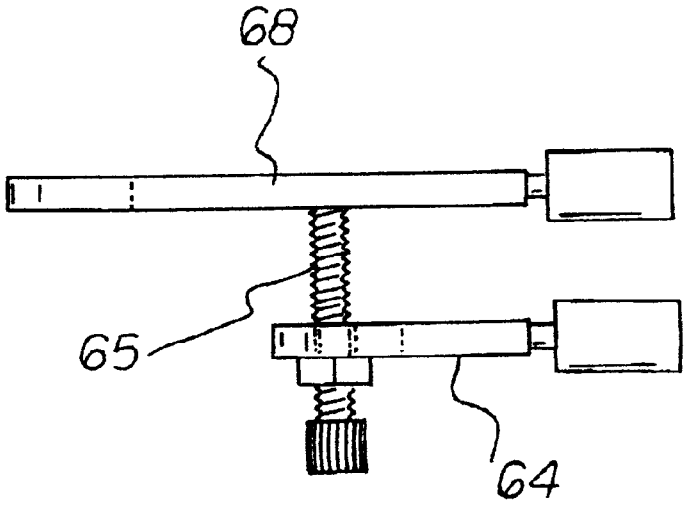
FIG 13

FIG 14
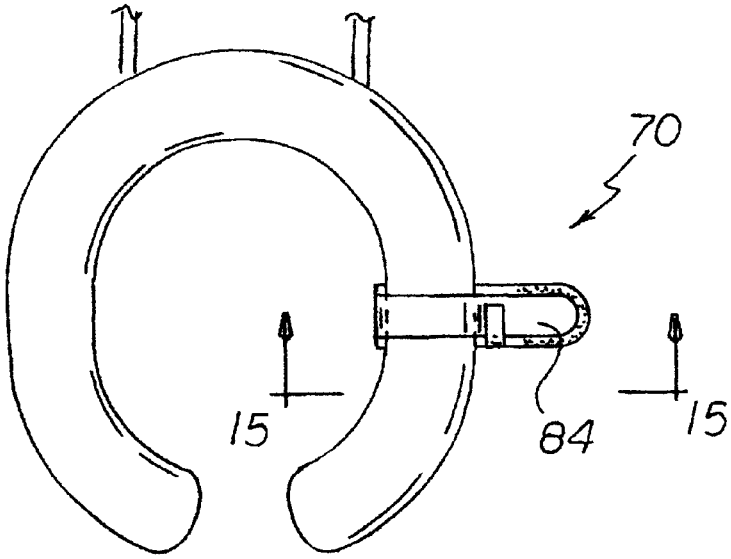
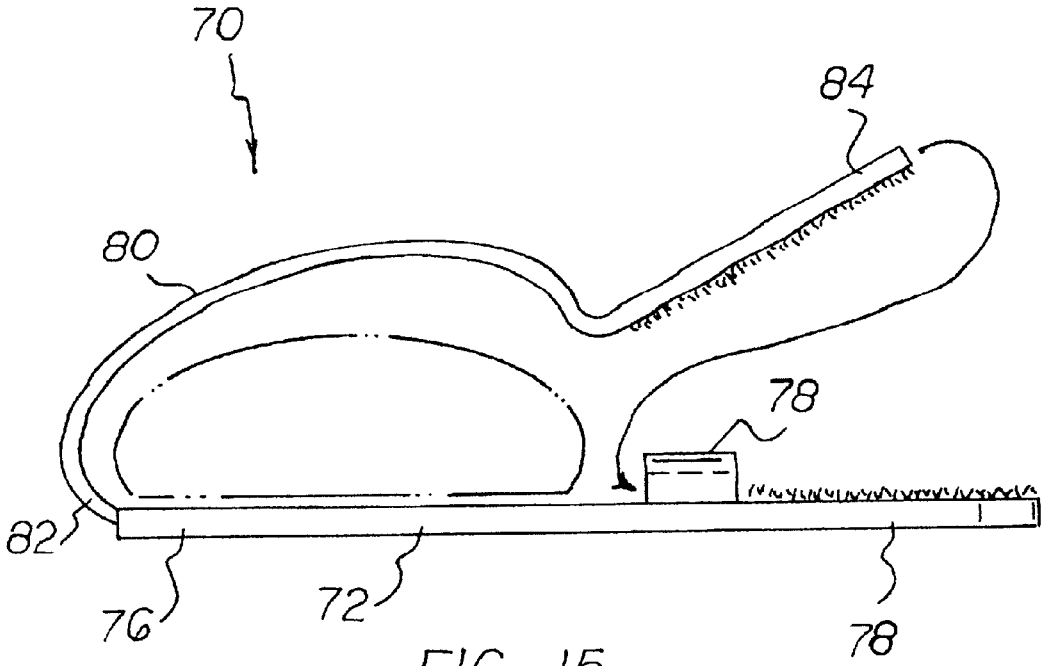
FIG 15

FOOT OPERATED COMMODE SYSTEM

BACKGROUND OF THE INVENTION

1. Field of the Invention

The present invention relates to a foot operated commode system and more particularly pertains to providing clean and efficient hands-free operation of a commode.

2. Description of the Prior Art

The use of commode systems of known designs and configurations is known in the prior art. More specifically, commode systems of known designs and configurations previously devised and utilized for the purpose of operating commodes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,736,470 issued Apr. 12, 1988, to Classon discloses a lifting assembly for lid and seat structures of a toilet. U.S. Pat. No. 6,230,336 issued May 15, 2001, discloses an automated toilet seat and seat cover lifting and lowering system. U.S. Pat. No. 4,807,307 issued Feb. 18, 1989, to Sato et al. discloses a device for opening and closing the seating plate of the lavatory unit of the seat type. U.S. Pat. No. 5,339,468 to Lin issued Aug. 23, 1994, is entitled hopper lid and the flush mechanism of a flush toilet. Finally, U.S. Pat. No. 5,056,165 to Wescott, Sr. issued Oct. 15, 1991, is entitled commode flush and seat lift apparatus.

While these devices fulfill their respective, particular objectives and requirements, the aforementioned patents do not describe a foot operated commode system that allows providing clean and efficient hands-free operation of a commode.

In this respect, the foot operated commode system according to the present invention substantially departs from the conventional concepts and designs of the prior art, and in doing so provides an apparatus primarily developed for the purpose of providing clean and efficient hands-free operation of a commode.

Therefore, it can be appreciated that there exists a continuing need for a new and improved foot operated commode system which can be used for providing clean and efficient hands-free operation of a commode. In this regard, the present invention substantially fulfills this need.

SUMMARY OF THE INVENTION

In view of the foregoing disadvantages inherent in the known types of commode systems of known designs and configurations now present in the prior art, the present invention provides an improved foot operated commode system. As such, the general purpose of the present invention, which will be described subsequently in greater detail, is to provide a new and improved foot operated commode system and method which has all the advantages of the prior art and none of the disadvantages.

To attain this, the present invention essentially comprises a commode fabricated of porcelain. The commode has a commode base and a reservoir. The commode also has a lid adapted to couple to the top of the reservoir. A flushing apparatus is coupled to the reservoir. A handle is provided to operate the flushing apparatus. A seat is provided. The seat has a first hinge coupled to the commode base. The seat has a cover with a second hinge coupled to the commode base.

Next provided is a foot apparatus. The foot apparatus has a first peddle, a second peddle and a third peddle. Each peddle is of a general L-shaped configuration with a foot end and an operative end. Each peddle has a peddle base with a pivot axis adapted to couple to the associated peddle. The operative end of each pedal is coupled to an ensheathed wire. When activated the peddles pull on their respective ensheathed wires. The peddle bases each have a coupling device to attach the peddle bases together.

Next provided is a flushing mechanism. The flushing mechanism has a clamp holding the ensheathed wire of the first peddle to the reservoir. The wire is coupled to the handle of the flushing apparatus. In this manner when the first peddle is activated the wire is pulled thereby activating the flushing apparatus of the reservoir.

A seat raising apparatus is next provided. The seat raising apparatus has a platform with a plurality of attachment recesses. The platform is coupled to the commode base with a first lever coupled to the platform. The first lever is coupled to the wire of the second peddle and the seat of the commode adjacent to the first hinge. The seat raising apparatus is adapted to raise the commode seat when the wire is pulled upon activation of the second peddle. The seat raising apparatus also has an adjustable coupling screw protruding from it in an upward direction.

Next, a cover raising apparatus is provided. The cover raising apparatus has a second lever coupled to the platform. The second lever is coupled to the wire of the third peddle and the cover of the commode adjacent to the second hinge. The cover raising apparatus is adapted to raise the commode cover when the wire is pulled upon activation of the third peddle. The cover raising apparatus is contacted by the coupling screw.

Finally, in an alternative embodiment, a releasable handle is provided. The handle is adapted to raise and lower the seat of the commode. A firm plate is adapted to be placed under the seat of the commode. The firm plate has an interior end and an exterior end. A loop is provided between the interior and exterior ends. The releasable handle also has a flexible strap with a coupled end and a free end. The coupled end of the strap is fixed to the interior end of the firm plate. The free end of the strap is adapted to pass over the seat of the commode and through the loop of the firm plate. The exterior end of the firm plate and free end of the strap each have a pile type fastener to facilitate a tight coupling around one side of the commode seat.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foot operated commode system which has all of the advantages of the prior art commode systems of known designs and configurations and none of the disadvantages.

It is another object of the present invention to provide a new and improved foot operated commode system which may be easily and efficiently manufactured and marketed.

It is further an object of the present invention to provide a new and improved foot operated commode system which is of durable and reliable constructions.

An even further object of the present invention is to provide a new and improved foot operated commode system which is susceptible of a low cost of manufacture with regard to both materials and labor, and which accordingly is then susceptible of low prices of sale to the consuming public, thereby making such foot operated commode system economically available to the buying public.

Even still another object of the present invention is to provide a foot operated commode system for providing clean and efficient hands-free operation of a commode.

Lastly, it is an object of the present invention to provide a new and improved commode with a base, a reservoir, a lid adapted to couple to the top of the reservoir, a flushing apparatus coupled to the reservoir and with a handle, a seat with a first hinge coupled to the commode base and a cover with a second hinge coupled to the commode base. A foot apparatus has two peddles each with a peddle base with a pivot axis adapted to couple to the peddle. An operative end of each pedal is coupled to an ensheathed wire. A seat raising apparatus has a platform coupled to the base of the commode with a first lever coupled to the platform coupled to the wire of the first peddle and the seat of the commode adjacent to the first hinge. A cover raising apparatus has a second lever coupled to the platform with the second lever being coupled to the wire of the second peddle and the cover of the commode adjacent to the second hinge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the present invention taken along line 3—3 of FIG. 1 showing the platform with the levers of the seat raising apparatus and the cover raising apparatus.

FIG. 4 is a plan view of the present invention taken along line 4—4 of FIG. 3.

FIG. 5 is a side elevational view of the present invention taken along line 5—5 of FIG. 1 showing the seat and cover.

FIG. 6 is a front elevational view of the present invention taken along 6—6 of FIG. 5.

FIG. 12 is a rear elevational view taken along line 12—12 of FIG. 9.

FIG. 13 is a rear elevational view similar to FIG. 12 but configured for left hand adjustment.

FIG. 14 is a plan view of the seat with an attached handle.

FIG. 15 is a cross sectional view taken along line 15—15 of FIG. 14.

The same reference numerals refer to the same parts throughout the various Figures.

DESCRIPTION OF THE PREFERRED EMBODIMENT

Figure 1:
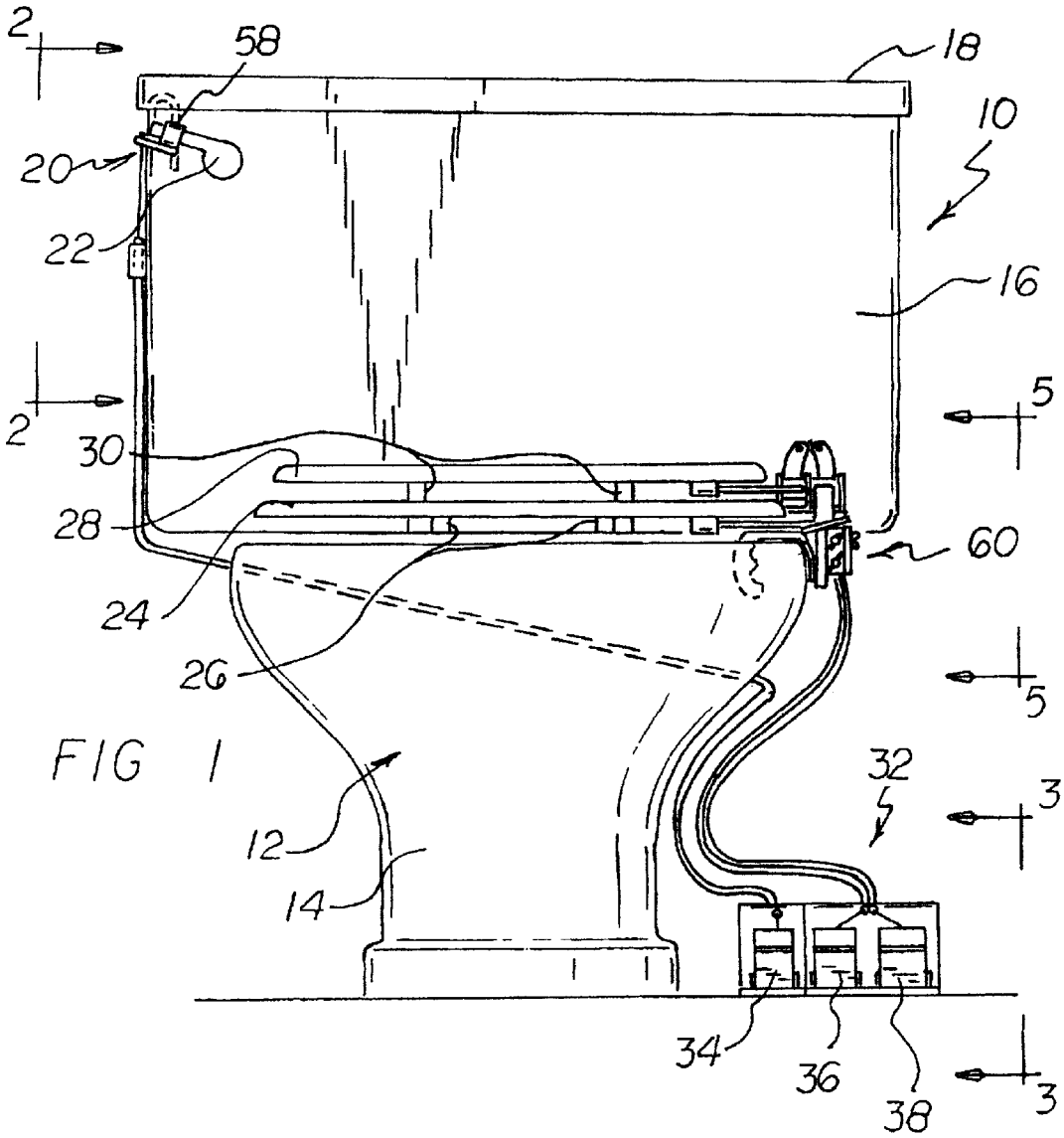
FIG. 1 is a front elevational view of the present invention in accordance with the enclosed specification.
Figure 2:
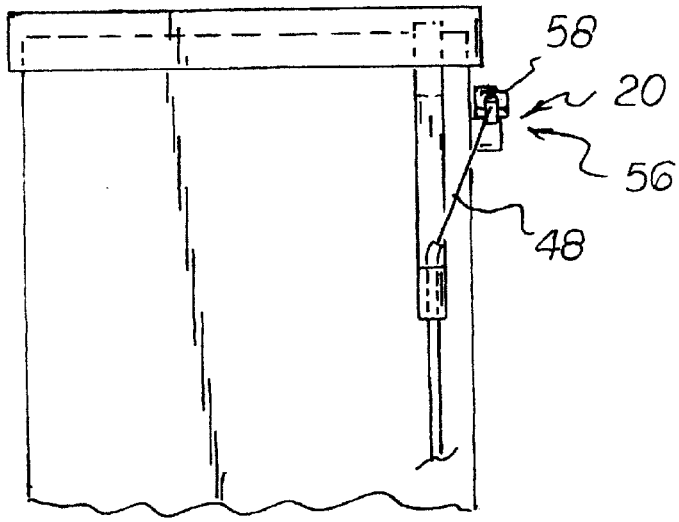
FIG. 2 is a side view of the present invention taken along line 2—2 of FIG. 1 showing the flushing apparatus and the flushing mechanism.
Figure 7:
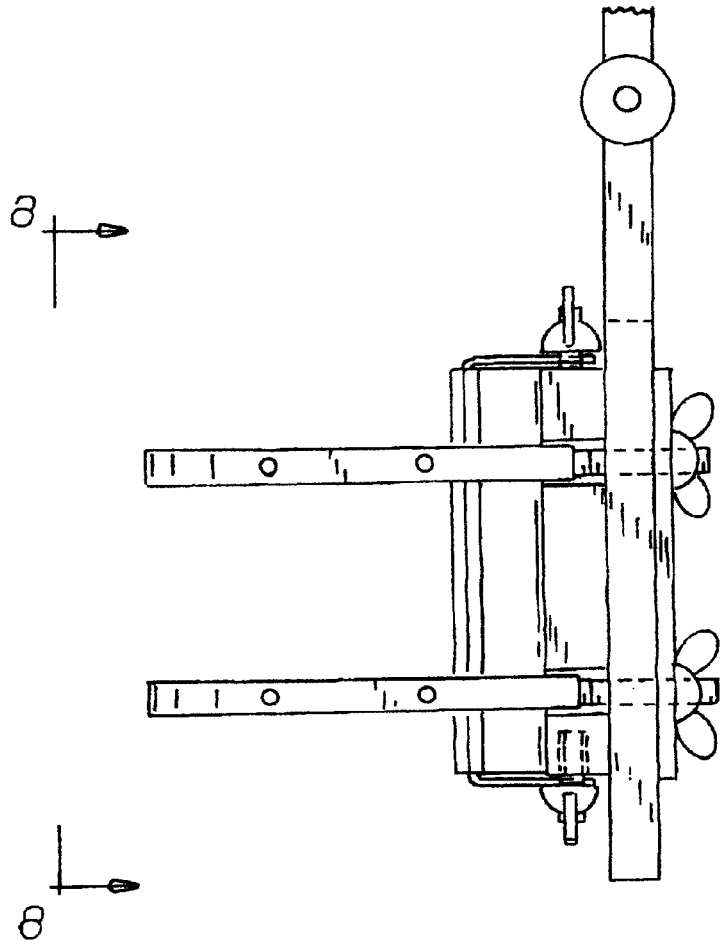
FIG. 7 is a plan view of the present invention taken along line 7—7 of FIG. 6.
Figure 8:
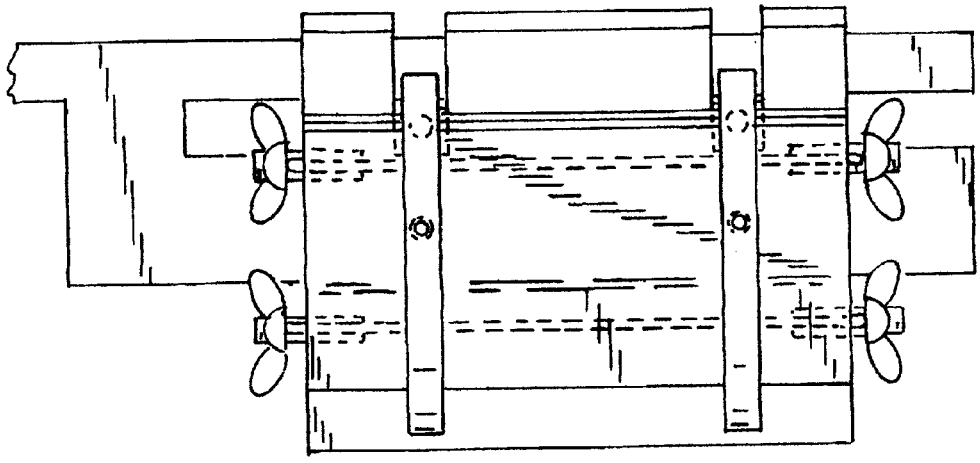
FIG. 8 is a side elevational view of the present invention taken along line 8—8 of FIG. 7.
Figure 9:
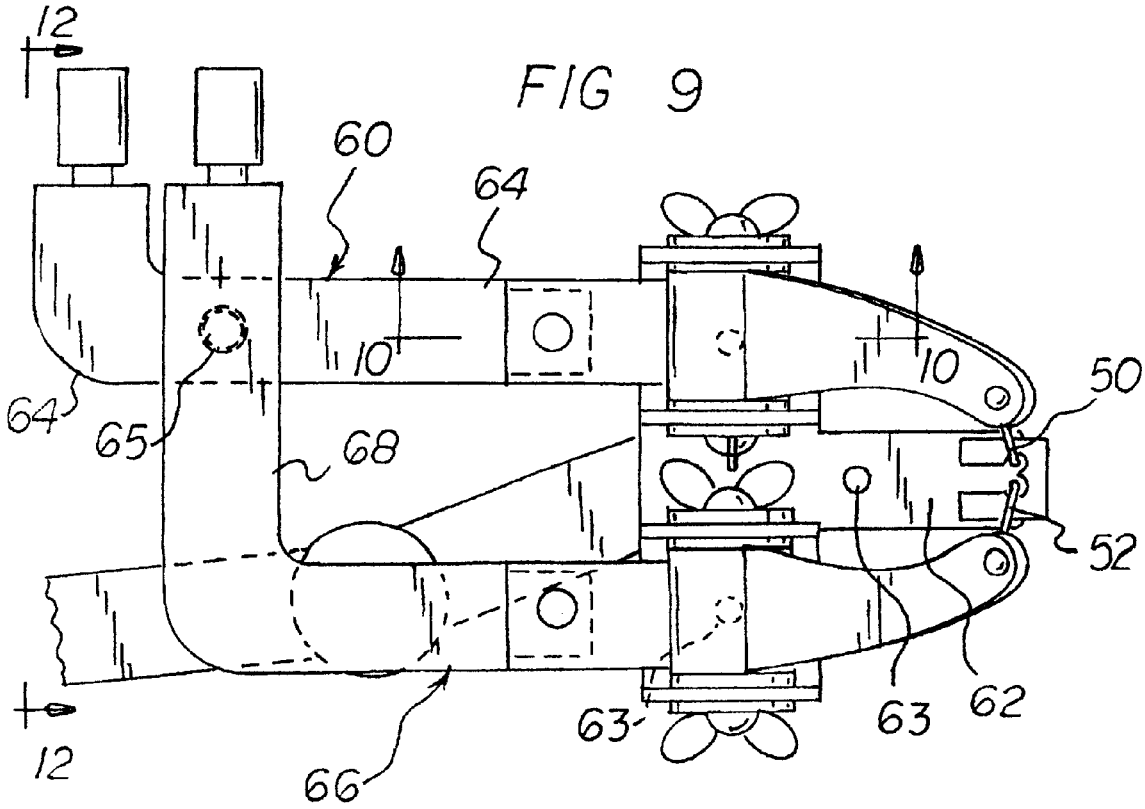
FIG. 9 is a side elevational view of the seat and cover raising apparatus.
Figure 10:
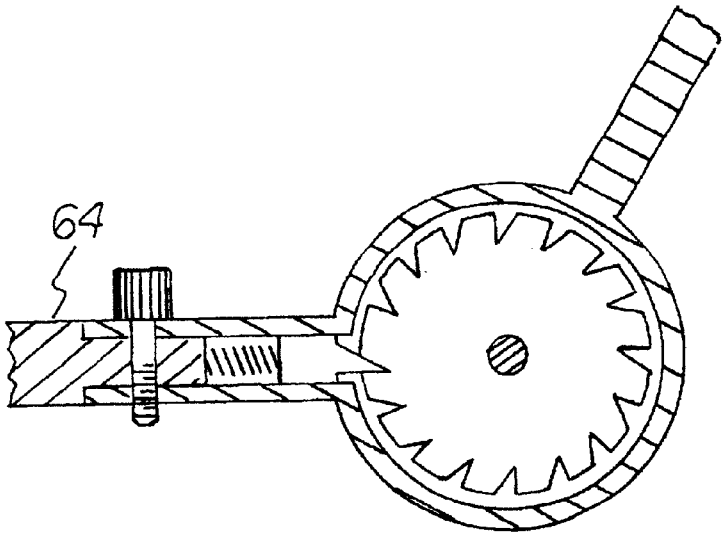
FIG. 10 is a cross sectional view taken along line 10—10 of FIG. 9.
Figure 11:
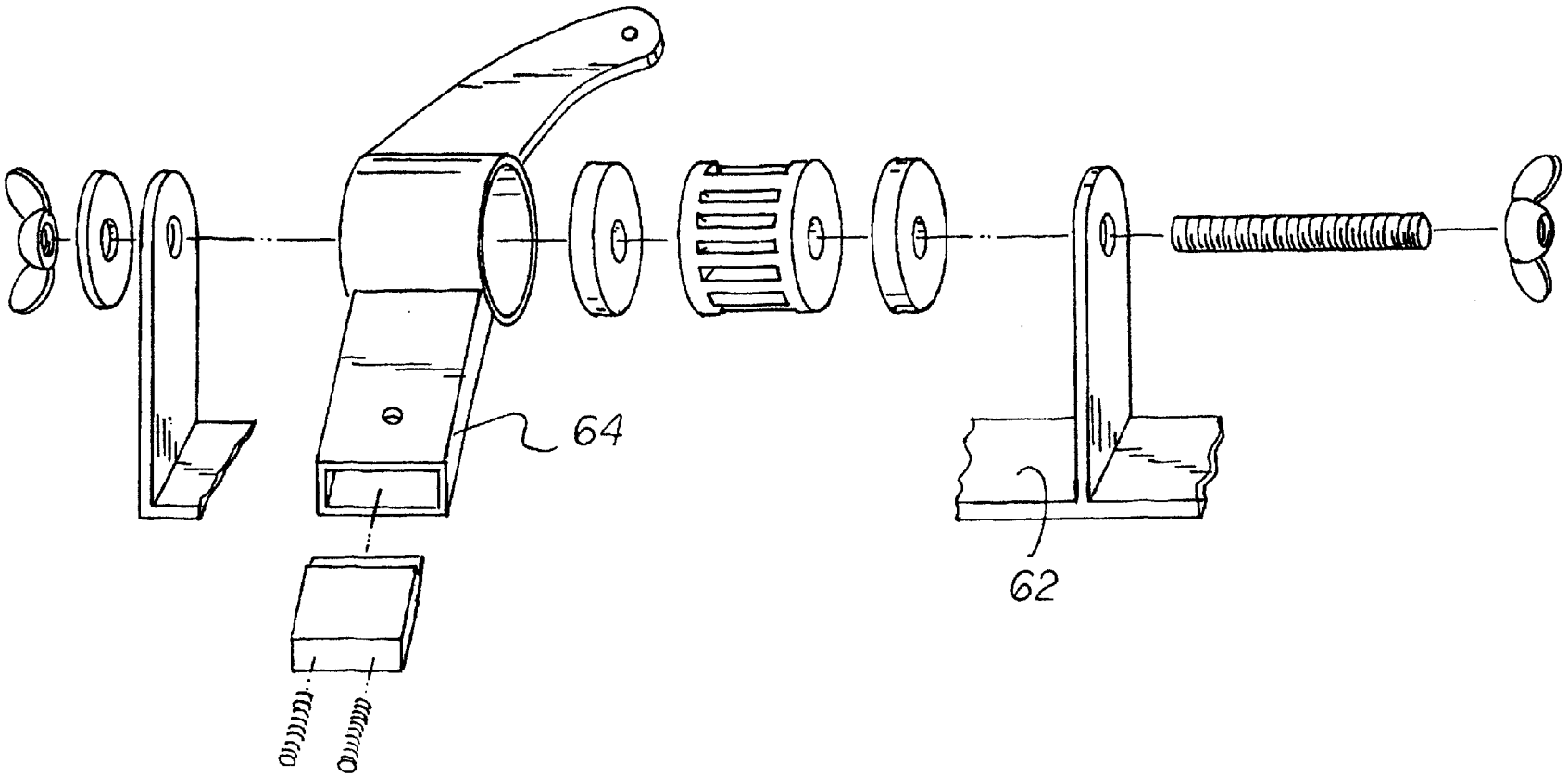
FIG. 11 is an exploded perspective view of the seat and cover raising apparatus.

With reference now to the drawings, and in particular to FIG. 1 thereof, the preferred embodiment of the new and improved foot operated commode system embodying the principles and concepts of the present invention and generally designated by the reference numeral 10 will be described.

The present invention, the foot operated commode system 10 is comprised of a plurality of components. Such components in their broadest context include a commode, a foot apparatus, a seat raising apparatus, and a cover. Such components are individually configured and correlated with respect to each other so as to attain the desired objective.

First provided is a commode 12 fabricated of porcelain. The commode has a commode base 14 and a reservoir 16. The commode also has a lid 18 adapted to couple to the top of the reservoir. A flushing apparatus 20 is coupled to the reservoir. A handle 22 is provided to operate the flushing apparatus. A seat 24 is provided. The seat has a first hinge 26 coupled to the commode base. The seat has a cover 28 with a second hinge 30 coupled to the commode base.

Next provided is a foot apparatus 32. The foot apparatus has a first peddle 34, a second peddle 36 and a third peddle 38. Each peddle is of a general L-shaped configuration with a foot end 40 and an operative end 42. Each peddle has a peddle base 44 with a pivot axis 46 adapted to couple to the associated peddle. The operative end of each pedal is coupled to an ensheathed wire 48, 50, 52. When activated the peddles pull on their respective ensheathed wires. The peddle bases each have a coupling device 54 to attach the peddle bases together.

Next provided is a flushing mechanism 56. The flushing mechanism has a clamp 58 holding the ensheathed wire 48 of the first peddle to the reservoir. The wire is coupled to the handle of the flushing apparatus. In this manner when the first peddle is activated the wire is pulled thereby activating the flushing apparatus of the reservoir.

A seat raising apparatus 60 is next provided. The seat raising apparatus has a platform 62 with a plurality of attachment recesses 63 coupled to the commode base with a first lever 64 coupled to the platform. The first lever is coupled to the wire 50 of the second peddle and the seat of the commode adjacent to the first hinge. The seat raising apparatus is adapted to raise the commode seat when the wire is pulled upon activation of the second peddle. The seat raising apparatus has an adjustable coupling screw 65 threaded there through. The screw protrudes in an upwards direction.

Next, a cover raising apparatus 66 is provided. The cover raising apparatus has a second lever 68 coupled to the platform. The second lever is coupled to the wire 52 of the third peddle and the cover of the commode adjacent to the second hinge. The cover raising apparatus is adapted to raise the commode cover when the wire is pulled upon activation of the third peddle. The cover apparatus is contacted by the coupling screw of the seat raising apparatus, causing the cover and seat raising to occur simultaneously.

Finally, in an alternative embodiment a releasable handle 70 is provided. The handle is adapted to raise and lower the seat of the commode. A firm plate 72 is adapted to be placed under the seat of the commode. The firm plate has an interior end 74 and an exterior end 76. A loop 78 is provided between the interior and exterior ends. The releasable handle also has a flexible strap 80 with a coupled end 82 and a free end 84. The coupled end of the strap is fixed to the interior end of the firm plate. The free end of the strap is adapted to pass over the seat of the commode and through the loop of the firm plate. The exterior end of the firm plate and free end of the strap each have a pile type fastener to facilitate a tight coupling around one side of the commode seat.

The foot pedals work with the mechanism that attaches to the commode lid. They can work in a number of ways: spring, fluid, air, cable, electric, battery powered, remote controlled, etc. No matter which way the pressure to open the lid is, it is designed to close the lid without slamming. There are adjustments for different weight lids. Toilet lids won't slam on little boy's privates. There can be different qualities from cheaper to more expensive, performance and technology. The device can release good smelling scents. Scent balls can be mounted under the back mechanism that opens the lid so it is well hidden. Fragrance pads, powder, scent drops, etc. can also be used. Some models have freshener to hang inside a toilet to clean and sanitize inside the toilet with every flush. Adjustments for more or less fragrance can be made for desired strength of air freshener. Some embodiments have two pedals, one for each toilet lid. Certain toilets, commercial restrooms mostly, only have one lid in which case a one-foot pedal model is used. A radio attachment may be provided for music, weather, etc. A magazine rack may be attached to a foot pedal, or to a lifter. Different colors and different styles and shapes can be provided. Each mounting device allows for easy removal for proper and easy cleaning which is particularly important in all restrooms. New commode lids may be provided in some kits which are already attached to the lifter providing a new soft lid with foot pedal and lifter. A bypass is built into the unit in the event someone lifts the lid, closes the lid, or flushes manually.

A remote control may be provided so lifting, closing or flushing can be done for the person in a hurry. The remote can be mounted anywhere in the bathroom. In an embodiment with automatic closing of all lids after a desired time and fragrance being released each time the lid closes.

A pumping mechanism may be provided. The power of perhaps two pumps lifts the lid and the device can be pumped numerous times to store energy for a push button release for numerous uses. Pumping stored will also flush the commode.

Models may have various activated sayings or phrases that can be said every time the toilet is used. Put separate chips in for different levels of phrases and sayings. Examples are jokes, bible sayings, inspirational sayings, knowledgeable sayings or phrases, or prerecorded personal sayings or phrases, jokes or gags on the people that use the toilet.

The hose, wire, tube or whatever material is used to supply power or energy to open or close the lid, can be fastened to the toilet side by whatever means is desired for the neat, tucked away look. Easy removal provides for proper cleaning. Holders for feminine products or other items, even extra rolls of toilet paper or moist wipes can be included. Plant holders and dipping spoons may be provided for real or artificial plants. Pedals may glow or have light for a night-light, decorative light, etc. A motion detector on the foot pedals will save batteries on night-light.

The flushing foot cable will be in a certain common length with an optional attachable cable for handles that are higher than normal, mostly commercial restrooms and stand up toilets, urinals. The foot pedal fastens to the floor and then the foot pedal locks to the holder by key for anti-theft as well as the unit attached to the commode. A common slot allows for all different attachments.

Different grips may be provided for foot pedals to work properly on different types of floors, carpet, tile, etc. A mat may be sold separately to be placed in front and wrapped around to the side of the toilet to work with the material on the bottom of the foot pedals for a no slip grip. The foot pedals may be heavy or may be filled with material like sand or water to make it heavier to stay in place better. The flusher pedal joins together with lid pedals for more stability and convenience. A battery powered model may charge itself to last longer by using the force generated when the lid is closed to wind up chargers. Only a touch of the pedal will lower the lid.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foot operated commode system for providing clean and efficient hands free operation of a commode comprising, in combination:

a commode being fabricated of porcelain having a commode base, a reservoir, a lid adapted to couple to the top of the reservoir, a flushing apparatus coupled to the reservoir and having a handle to operate the flushing apparatus, a seat with a first hinge coupled to the commode base and a cover with a second hinge coupled to the commode base;

a foot apparatus having a first peddle, a second peddle and a third peddle each peddle being of a general L-shaped configuration with a foot end and an operative end and each peddle having a peddle base with a pivot axis adapted to couple to the associated peddle, the operative end of each pedal being coupled to an ensheathed wire, so that when activated the peddles pull on their respective ensheathed wires, the peddle bases each having a coupling device to attach the peddle bases together;

a flushing mechanism being comprised of a clamp holding the ensheathed wire of the first peddle to the reservoir, the wire being coupled to the handle of the flushing apparatus such that when the first peddle is activated the wire is pulled thereby activating the flushing apparatus of the reservoir;

a seat raising apparatus comprising a platform with a plurality of attachment recesses, the platform being coupled to the commode base with a first lever coupled to the platform, the first lever being coupled to the wire of the second peddle and the seat of the commode adjacent to the first hinge, the seat raising apparatus being adapted to raise the commode seat when the wire is pulled upon activation of the second peddle with an adjustable coupling screw coupled to the seat raising apparatus lever through a threaded hole, with the screw protruding upward; and a cover raising apparatus comprising a second lever coupled to the platform with the second lever being coupled to the wire of the third peddle and the cover of the commode adjacent to the second hinge, the cover raising apparatus being adapted to raise the commode cover when the wire is pulled upon activation of the third peddle with the cover raising apparatus being contacted by the seat raising apparatus coupling screw.

2. A foot operated commode system comprising:

a commode having a base, a reservoir, a lid adapted to couple to the top of the reservoir, a flushing apparatus coupled to the reservoir and having a handle, a seat with a first hinge coupled to the commode base and a cover with a second hinge coupled to the commode base;

a foot apparatus having a first peddle and a second peddle each with a foot end and an operative end and each peddle having a peddle base with a pivot axis adapted to couple to the peddle, the operative end of each pedal being coupled to an ensheathed wire;

a seat raising apparatus comprising a platform coupled to the base of the commode with a first lever coupled to the platform, the first lever being coupled to the wire of the first peddle and the seat of the commode adjacent to the first hinge; and a cover raising apparatus comprising a second lever coupled to the platform with the second lever being coupled to the wire of the second peddle and the cover of the commode adjacent to the second hinge.

3. The system as set forth in claim 2 and further including a flushing mechanism.

4. The system as set forth in claim 3 and further including a third pedal coupled to the flushing mechanism.

5. The system as set forth in claim 2 whereby the a foot apparatus having a first peddle and a second peddle each with a foot end and an operative end and each peddle having a peddle base with a pivot axis, with each pedal operating a hydraulic system, said hydraulic system coupling the pedal and the seat raising apparatus by the means of a hydraulic piping, enabling the system to be operated hydraulically.

6. The system as set forth in claim 2 whereby the system also comprises a releasable handle adapted to raise and lower the seat of the commode comprising a firm plate adapted to be placed under the seat of the commode and having an interior end, an exterior end and a loop therebetween, and the releasable handle also having a flexible strap with a coupled end and a free end, the coupled end of the strap being fixed to the interior end of the firm plate and the free end of the strap being adapted to pass over the seat of the commode and through the loop of the firm plate, the exterior end of the firm plate and free end of the strap each having a pile type fastener to facilitate a tight coupling around one side of the commode seat.

* * * * *